United States Patent [19]

Terazono et al.

[11] 4,351,416

[45] Sep. 28, 1982

[54] ELEVATOR CONTROL DEVICE

[75] Inventors: Narihiro Terazono; Ryuichi Kajiyama, both of Inazawa, Japan

[73] Assignee: Mitsubishi Denki Kabushiki Kaisha, Tokyo, Japan

[21] Appl. No.: 207,547

[22] Filed: Nov. 17, 1980

[30] Foreign Application Priority Data

Nov. 19, 1979 [JP] Japan ..... 54-149701
Nov. 22, 1979 [JP] Japan ..... 54-151835

[51] Int. Cl.[3] ..... B66B 1/30
[52] U.S. Cl. ..... 187/29 R
[58] Field of Search ..... 187/29

[56] References Cited

U.S. PATENT DOCUMENTS

| | | | |
|---|---|---|---|
| 3,589,474 | 6/1971 | Waure | 187/29 |
| 3,643,762 | 2/1972 | Schibli | 187/29 |
| 3,743,055 | 7/1973 | Hoelscher et al. | 187/29 |
| 3,777,855 | 12/1973 | Boyldew et al. | 187/29 |
| 3,887,039 | 6/1975 | Boniek | 187/29 |
| 3,902,572 | 9/1975 | Ostrander | 187/29 |

*Primary Examiner*—J. V. Truhe
*Assistant Examiner*—W. E. Duncanson, Jr.
*Attorney, Agent, or Firm*—Sughrue, Mion, Zinn, Macpeak & Seas

[57] ABSTRACT

An elevator control device which selectively employs an operational mode in which the cage of the elevator is run at a maximum rated speed or an operational mode in which the cage is run at a speed lower than the rated speed as determined by distance codes read out from a memory. The cage is accelerated in accordance with an acceleration signal the value of which is determined by the total distance between the start and stop floors. A deceleration instruction signal is produced in accordance with the difference between the acceleration instruction signal and the distance to the floor at which the cage is to be stopped. The acceleration instruction signal is compared with the deceleration instruction signal and a decision is made as to which is utilized as a speed instruction signal to a motor operating the elevator cage in accordance with which is the larger.

3 Claims, 21 Drawing Figures

7
6
7A
5
6A
4
5A
4A
3
3A
2
2A
1
0
tF
0
V/2 tF
tF
0
tF

ELEVATOR CONTROL DEVICE

BACKGROUND OF THE INVENTION

The present invention relates to an improved device for providing speed instruction signals for an elevator.

A speed feedback control system has previously been employed in which the speed of the cage of an elevator is controlled according to deceleration instruction signals so that the cage is decelerated and stopped at desired floors without exerting uncomfortably high acceleration or deceleration forces. Recently, a method has been proposed in which the speed feedback control system is effected with an electronic computer.

In the conventional method, as described in detail later, a cage position signal is detected by counting the number of pulses corresponding to the distance through which the cage has moved. When the cage reaches a position a predetermined distance before a floor where the cage is to be stopped, by counting pulses, the remaining distance between the position and the desired floor is successively calculated and a deceleration instruction value corresponding to the remaining distance thus calculated is read out as a deceleration instruction signal. The cage is decelerated in accordance with this signal until it stops at the desired floor.

If the maximum rated speed of the cage of the elevator is 90 m/min or higher, sometimes it is impossible to run the cage at the maximum rated speed during a period of running the cage because it is strongly required that a person in the cage not be made uncomfortable. Accordingly, in this case, it is necessary that the cage run at a speed (hereinafter referred to as "a partial speed" when applicable) lower than the rated speed. In general, whether or not the cage should be run at the rated speed is determined according to the number of floors, that is, the distance between floors, and the highest speed during a run is also determined according the number of floors. For instance with a maximum rated speed of 90 m/min, the partial speed may be employed for single-floor operation and the rated speed employed for operations other than single-floor operation. With a rated speed of 105 m/min, the partial speed may be employed for single-floor operation and two-floor operation, and the rated speed employed for three-floor operation amd more-than-three-floor operation. The term "single-floor operation" is intended to mean that the cage is moved between two adjacent floors, for instance, from the first floor to the second floor. The term "two-floor operation" is intended to mean that the cage is moved, for instance, from the first floor to the third floor. The same concept is applicable to the term "three-floor operation", etc.

Depending on the construction of a building, the distances between the floors may not be uniform. Therefore, if the distance between adjacent floors is sufficiently long, the maximum rated speed may be employed for single-floor operation. However, in the conventional system, for such a short floor distance the cage is run at the partial speed and accordingly the transportation efficiency is unavoidably low. Especially in an AC elevator using an induction motor as its hoisting motor, running the cage at a low speed increases power consumption with the motor generating much heat. This operation is uneconomical. That is, running an AC elevator at the maximum rated speed provides the highest efficiency. If, in an elevator employing DC braking or opposite phase braking for decelerating the cage, DC braking or opposite phase braking is applied to the cage while it is moving downwardly with a full load, the heat generation and power consumption of the motor are increased. Therefore, it is necessary to apply the full voltage to the motor and to apply regenerative braking to the motor during deceleration. Thus, it is very important to determine whether or not the cage can be run at the rated speed.

Accordingly, an object of the invention is to provide an elevator control device in which the above-described difficulties have eliminated. More specifically, it is an object of the invention to provide such an elevator control device in which it can be readily determined whether or not the cage can be run at the maximum rated speed and in which operational modes corresponding to high transportation efficiency can be selectively employed.

SUMMARY OF THE INVENTION

These, as well as other objects of the invention, are met by an elevator control device for selectively employing an operational mode which a cage is run at a maximum rated speed or an operational mode in which the cage is run at a speed lower than the rated speed including memory means and reading out means. The memory means stores floor distance codes representative of distances between floors. The reading out means reads the codes out of the memory means in accordance with the distance between a floor where the cage is started from and a floor to which the cage is to be moved to and subsequently stopped for selecting at least one of an operational mode in which the cage is run at a maximum rated speed and an operational mode in which the cage is run at a speed lower than the maximum rated speed in accordance with values corresponding to the floor distance codes correspondingly selected. Accordingly, the cage is accelerated by an acceleration instruction signal. When the cage reaches a position a predetermined distance before the floor where it is to be stopped, the remaining distance between the current position and the floor where the cage is to be stopped is calculated to provide a deceleration instruction signal which corresponds to the remaining distance. The acceleration instruction signal is compared with the deceleration instruction signal and, when the acceleration instruction signal is smaller than the deceleration instruction signal, the acceleration instruction signal is provided as a speed instruction signal. When the acceleration instruction signal is equal to or larger in value than the deceleration instruction signal, the deceleration instruction signal is provided as the speed instruction signal.

BRIEF DESCRIPTION OF THE DRAWINGS

FIGS. 8–21 are a series of flow charts describing in detail the programmed operation of the speed instruction generator.

DESCRIPTION OF THE PREFERRED EMBODIMENTS

Figure 1:
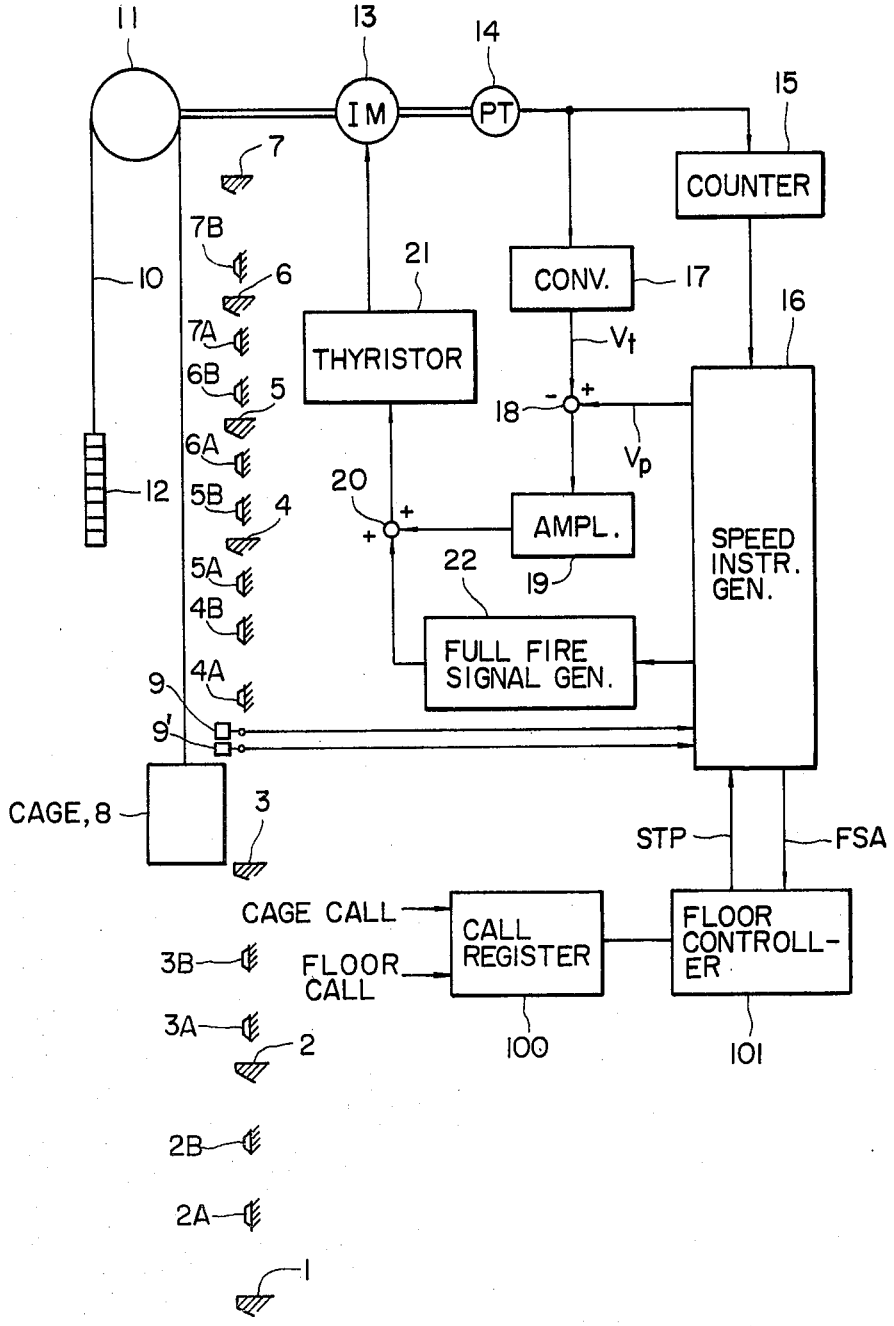
FIG. 1 is a block schematic diagram of an elevator system constructed in accordance with the present invention.

Preferred embodiments of the invention will be described with reference to FIGS. 1 through 6. In these figures, reference numerals 1 through 7 designate the first through seventh floors, respectively. Among the distances between the floors, the distance between the third floor 3 and the fourth floor 4 is the longest, the distance between the first floor 1 and the second floor 2, which is equal to that between the second floor 2 and the third floor 3, is the next longest, and the distances between the fourth floor 4 and the fifth floor 5, between the fifth floor 5 and the sixth floor 6 and between the sixth floor 6 and the seventh floor 7 are the shortest and are equal to one another. Further in these figures, reference characters 2A through 7A designate up maximum rated speed deceleration preparation point detecting cams which are disposed predetermined distances before the second through seventh floors, respectively, 2B through 7B up partial speed deceleration preparation point detecting cams which are disposed at positions which are closer to the second through seventh floors than the cams 2A through 7A, respectively, 8 the cage of an elevator, 9 an up maximum rated speed operation deceleration point detector having a switch, 9′ an up partial speed operation deceleration point detector having a switch provided in the cage, 10 a main cable, 11 the sheave of a hoist, 12 a balance weight, 13 an induction motor for driving the sheave 11, 14 a pulse generator driven by the motor 13 for producing pulses in proportion to the speed of the motor 13, 15 a counter for counting the number of pulses provided by the pulse generator 14, and 16 a speed instruction generating device employing a microprocessor. The speed instruction generating device 16 receives the contents of the counter 15 and in response thereto outputs a speed instruction signal Vp through a digital-to-analog (D/A) converter 210 and a waveform shaping circuit 211.

Referring to FIG. 1, reference numeral 17 designates a converter which counts the number of pulses outputted by the pulse generator 14 and converts the count result into a speed signal Vt proportional to the speed of the motor 13, 18 a subtractor for producing a signal corresponding to the difference between the speed instruction signal Vp (outputted by the converter 18) and the speed signal Vt, 19 an amplifier, 20 an adder, 21 a thyristor device for applying a firing-controlled voltage to the motor 13, 22 a full-firing signal generator for producing a full-firing signal, 100 a call register in which a cage call and a floor call are stored, and 101 a floor controller in which the output of the call register is compared with a forward floor instruction FSA provided by the speed instruction generating device 16 to output a stop determination signal STP which is loaded into the speed instruction generating device.

Figure 2:
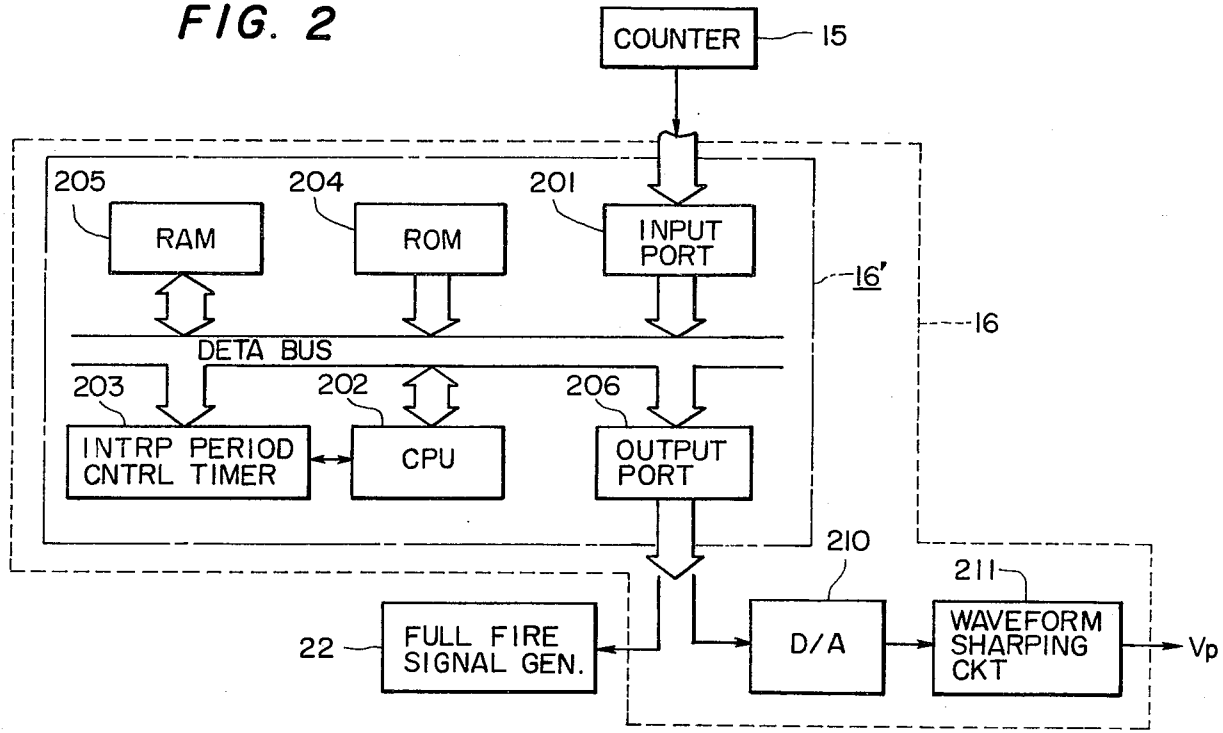
FIG. 2 is a block diagram of a speed instruction generator used in the elevator system of FIG. 1.

FIG. 2 is a block diagram showing the speed instruction generating device 16. The device 16 includes a microprocessor 16′ which is Model 8085 made by Intel Co. in the preferred embodiment. However, it may be a microprocessor of a different type or a digital computer. The microprocessor 16′ is constituted by an input port 201 (Intel Co. Model 8212), a central processing unit (CPU) 202 (Intel Co. Model 8085A), an interruption period control timer 203 (Intel Co. Model 8155), a read-only memory (ROM) 204 (Intel Co. Model 2114A), and an output port 206 (Intel Co. Model 8212).

Figure 3:
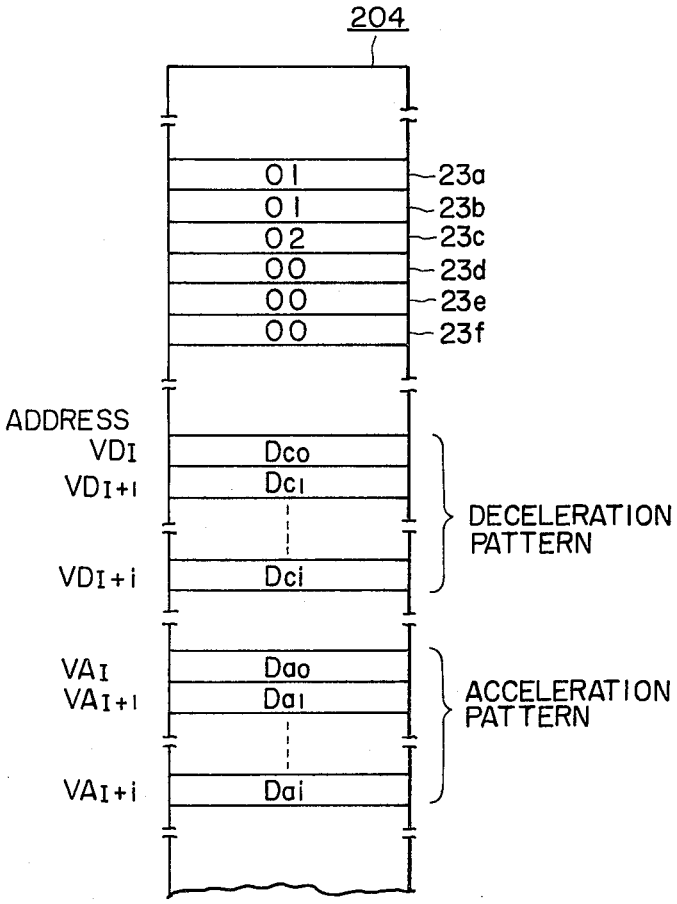
FIG. 3 is a diagram of the speed instruction signal generating program stored in the read-only memory of the speed instruction generator shown in FIG. 2.

A speed instruction signal generating program as shown in FIG. 3 is stored in the read-only memory 204 and, furthermore, coded floor distances 23*a* through 23*f* (hereinafter referred to as "floor distance codes 23*a* through 23*f*") are stored in the memory 204. The floor distance codes are as follows:

"02" . . . Single-floor operation and a floor distance for which the maximum rated speed running is permitted.

"01" . . . Two-floor operation and a floor distance for which the maximum rated speed running is permitted (floor distances excluding the distance between the third floor 3 and the fourth floor 4)

"00" . . . Three-floor operation and a floor distance for which the rated speed running is permitted (floor distances excluding the distance between the third floor 3 and the fourth floor 4)

For instance, in the case of an elevator having a maximum rated speed of 150 m/min, the floor distance code for a floor distance of 3000 mm is "00", the floor distance code for a floor distance of from more than 3000 mm to less than 6000 mm is "01", and the floor distance code for a floor distance more than 6000 mm is "02".

In the embodiment described, the floor distance codes 23*a* and 23*b* for the distances between the first floor 1 and the second floor 2 and between the second floor 2 and the third floor 3 are "01", the floor distance code 23*c* for the distance between the third floor 3 and the fourth floor 4 is "02", and the floor distance codes 23*d*, 23*e* and 23*f* for the distances between the fourth floor 4 and the fifth floor 5, between the fifth floor 5 and the sixth floor 6 and between the six floor 6 and the seventh floor 7 are "00". Thus, shortest floor distances for which the rated speed running can be permitted are available between the first floor 1 and the third floor 3, between the third floor 3 and the fourth floor 4, and between the fourth floor 4 and the seventh floor 7.

Deceleration instruction data corresponding to the remaining distance from the cage to a stop-designated floor is stored in the ROM 204.

The operation of the embodiment thus organized will be described.

It is assumed that the cage 8 is at the third floor 3 and a call for the fourth floor 4 has been received. The floor distance code 23*c* is read out of the ROM 204. The code 23*c* is "02". Accordingly, the maximum rated speed running is utilized to run the cage. For the speed instruction signal Vp, an acceleration is calculated by the central processing unit 202 and is outputted through the output port 206. The speed signal Vt is outputted by the converter 17. The difference signal corresponding to the difference between the speed signal Vt and the speed instruction signal Vp produced by the subtractor 18 is amplified by the amplifier 19 and is applied to the thyristor device 21 in response to which the speed of the motor 13 and accordingly the speed of the cage 8 are controlled with high accuracy.

Figure 4:
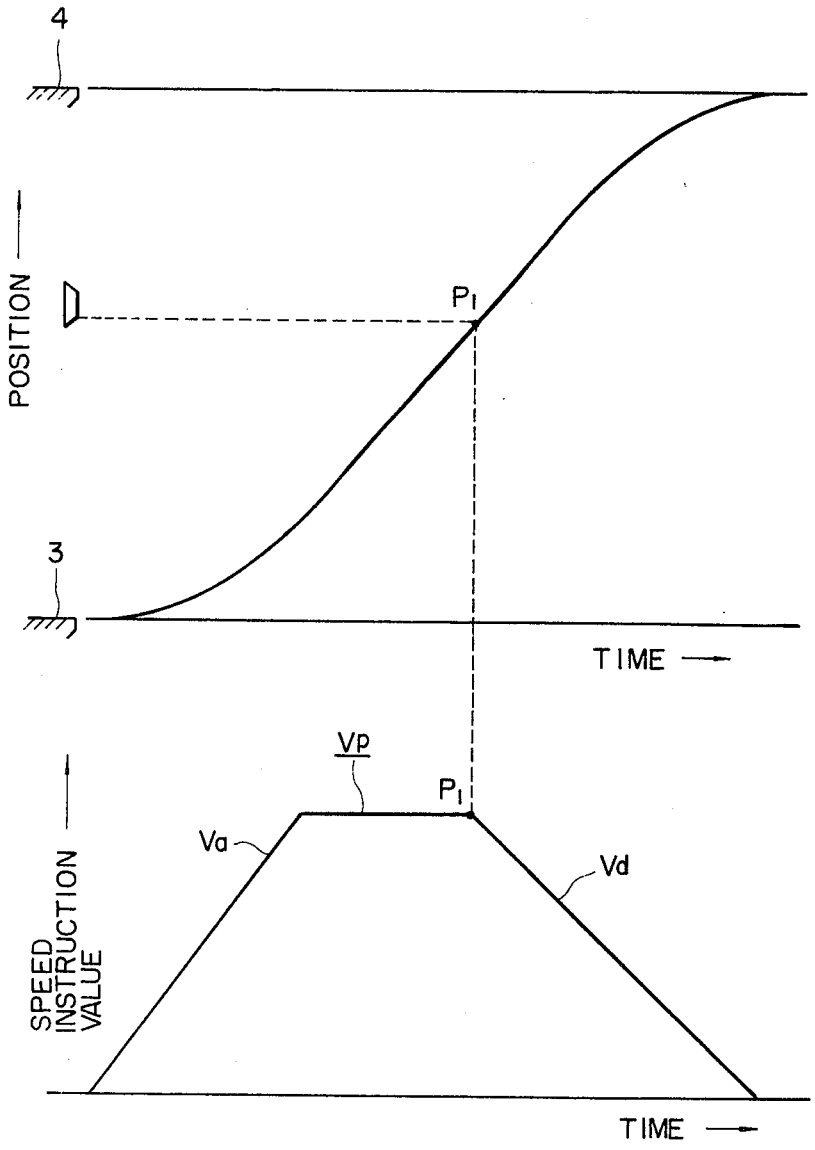
FIGS. 4–6 are a series of diagrams showing the elevator cage position and corresponding speed instruction signal value for various conditions.

After the speed instruction signal Vp reaches the level corresponding to the maximum rated speed, the rated speed is maintained. At the same time, with the aid of the output of the output port 206, the full-firing signal generator 22 provides an output to full-fire the thyristor device 21 so that the maximum rated voltage is applied to the motor 13 and the cage 8 is run at the maximum rated speed. The heat generation and power consumption of the motor is therefore reduced. When the cage 8 reaches a deceleration preparation point $P_1$ a predetermined distance before the fourth floor 4, the detector 9 engages the cam 4A to provide an output. The output is detected by the speed instruction generating device 16 as a result of which the calculation of the remaining distance is started. A deceleration instruction signal Vd corresponding to the remaining distance is read out of the ROM 204 and is outputted through the output port. The waveform of the speed instruction signal Vp thus produced is shown in FIG. 4.

Figure 5:
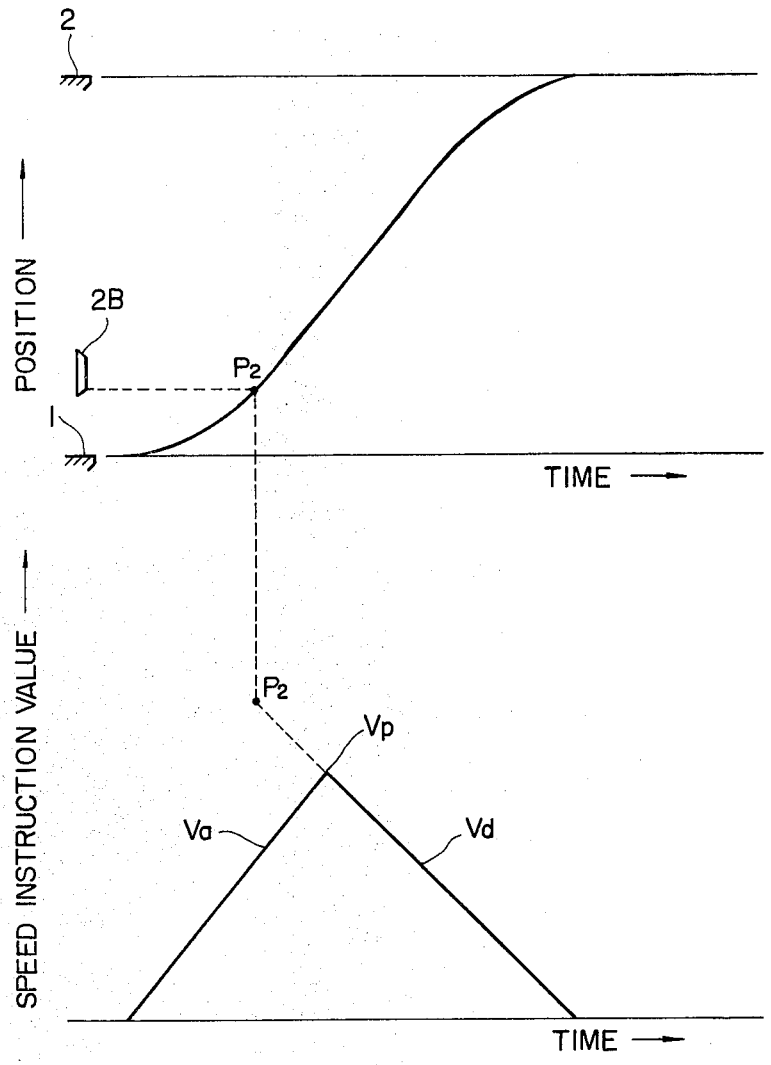

In the case where the cage 8 at the first floor is moved to the second floor, the floor distance code 23*a* is read out of the ROM 204. The code 23*a* is "01" for single-floor operation and therefore partial speed running is used to start the running of the cage. At the same time, the output of the full-firing signal generator 22 is zeroed. Similar to the above-described case, the acceleration instruction signal Va is produced as the speed instruction signal Vp so that the speed of the cage 8 is controlled with high accuracy. When the cage 8 reaches a deceleration preparation point $P_2$ a predetermined distance before the second floor 2, the detector 9' engages the cam 2B to provide an output as a result of which the calculation of the remaining distance is started. A deceleration instruction signal Vd corresponding to the remaining distance is read out similar to the above-described case. The deceleration instruction signal Vd is compared with the acceleration instruction signal Va. If $Vd > Va$, the acceleration instruction signal Va is provided by the output port 206. If $Vd \leqq Va$, the deceleration instruction signal Vd is provided by the output port 206. The waveform of the speed instruction signal Vp during the partial speed running is shown in FIG. 5.

Figure 6:
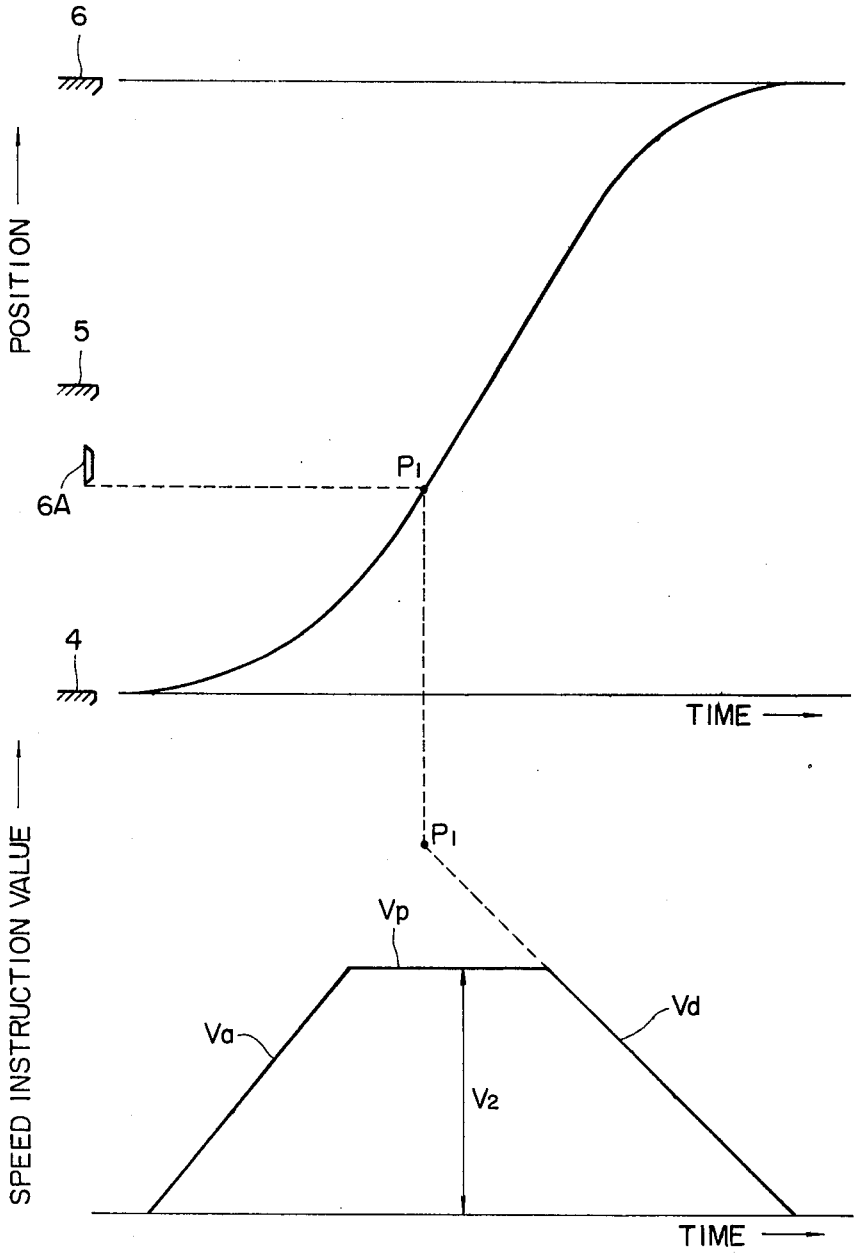

The above-described operation is similarly applicable to the operations between other floors. The floor distance codes and the operations from a start floor to a stop floor are as follows:

(a) Single-floor operation and floor distance code "02" . . . Maximum rated speed operation
(b) Single-floor operation and floor distance code "01" or less . . . Partial speed operation
(c) Two-floor operation and the sum of floor distance codes is "02" or more . . . Maximum rated speed operation
(d) Two-floor operation and the sum of floor distance codes is "01" or less . . . Partial speed operation
(e) Three-or-more-floor operation . . . Maximum rated speed operation In the case where, even with the partial speed operation, the running distance is relatively long as for instance, in running the cage between the fourth floor 4 and the sixth floor 6 or between the fifth floor 5 and the seventh floor 7, the maximum value $V_2$ of the speed instruction signal Va is maintained slightly lower than the value $V_1$ for maximum rated speed running as shown in FIG. 6. If $Va < Vd$, the acceleration instruction signal Va is produced as the speed instruction signal Vp while, if $Va \geqq Vd$, the deceleration instruction signal Vd is provided as the speed instruction signal Vp similar to the case of FIG. 5. The maximum value $V_2$ of the acceleration instruction signal Va is set so that, when the cage 8 reaches a position a predetermined distance L before a stop-designated floor, the cage 8 is sufficiently decelerated through the distance L.

The deceleration instruction signal Vd is an ideal one corresponding to the remaining distance between the cage and a stop-designated floor. Therefore, even if the load and the voltage are varied, position feedback is considerably positively effected with the aid of the ideal deceleration instruction signal Vd. Accordingly, passengers feel no discomfort and the cage reaches desired floors stably at all times.

As the acceleration instruction signal Va is compared with the deceleration instruction signal Vd at all times, the cage can be run at the highest speed which can be provided for a given floor distance and which is allowable for comfort, etc. Therefore, the operation efficiency is improved while the heat generation and power consumption of the motor 13 are minimized.

While the invention has been described with reference to the case where the cage is moved upwardly, the technical concept of the invention is similarly applicable to the case where the cage is moved downwardly.

Next, the speed instruction generating device 16 will be described with reference to FIGS. 7 through 20 in more detail.

Figure 8:
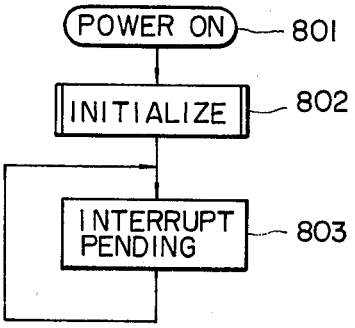
Figure 9:
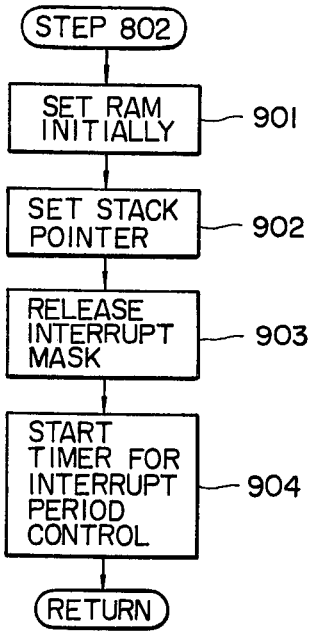

The speed instruction generating device 16 operates in accordance with a program as shown in FIG. 8 which is stored in the ROM 202. When the device 16 is activated in Step 801, initializing is automatically carried out in Step 802 and then interrupt pending is effected in Step 803. Step 802 for initializing, as shown in FIG. 9, includes Step 901 for RAM initial setting, Step 902 for stack pointer setting, Step 903 for interrupt mask release, and Step 904 for starting the interrupt period control timer (203).

Figure 10:
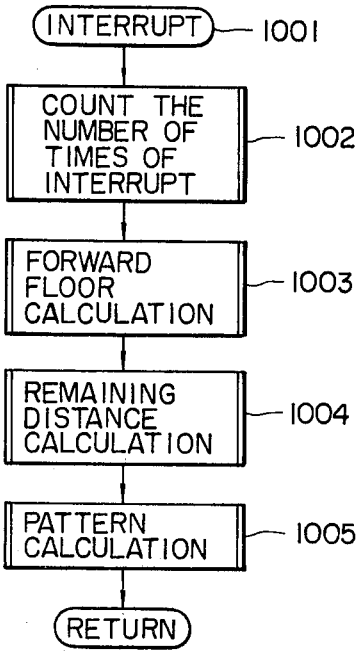
Figure 11:
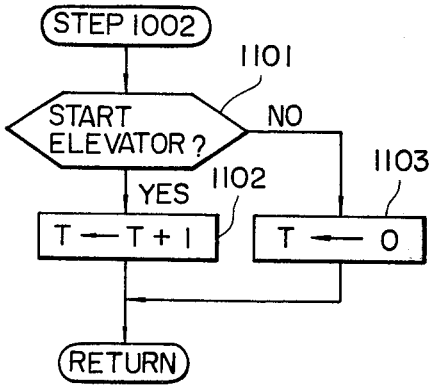

FIG. 10 illustrates the execution of the following program when an interrupt is initiated by the timer 203 in Step 1001. That is, the program includes Step 1002 for counting the number of interrupts, Step 1003 for forward floor calculation, Step 1004 for remaining distance calculation, and Step 1005 for pattern calculation. In Step 1002 for counting the number of interrupts, as shown in FIG. 11, it is determined whether or not the elevator was started in Step 1101, and if the elevator was started, the value of a variable T is increased by one in Step 1102. If the elevator is in the stopped state, the variable T is set to zero in Step 1103.

Figure 12:
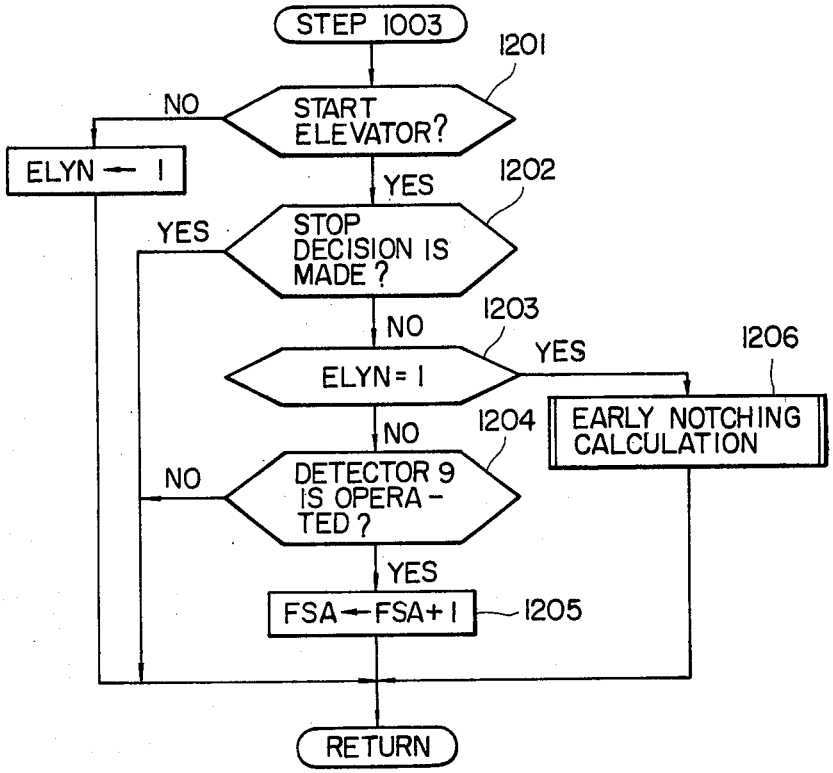

Step 1003 for forward floor calculation is illustrated in FIG. 12 in detail. When it is determined that the elevator was started in Step 1201, Step 1202 is effected. If in Step 1202 a stop decision is not made, the state of flag ELYN is decided in Step 1203. If ELYN=1, then Step 1206 for early notching calculation is effected. If ELYN has been reset to 0, Step 1204 is effected. In Step 1204, the operating state of the detector 9 is determined and whenever the detector 9 is operated by each of the cams 2A through 7A provided for the second through seventh floors, the forward floor instruction FSA is increased by one. When the elevator is in the stopped state (not started), the flag ELYN is set to 1 in Step 1207.

Figures 7A, 7B, 7C:
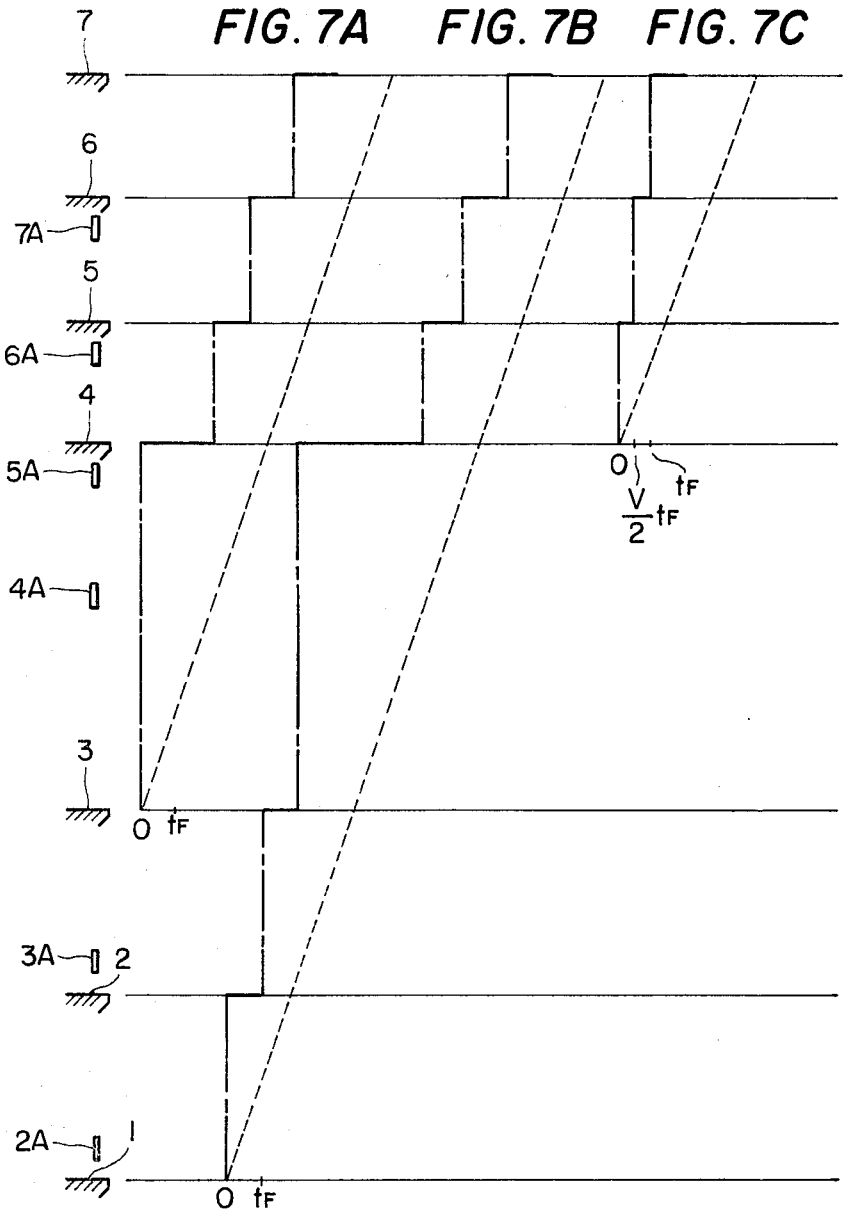
FIGS. 7A–7C are a series of diagrams showing the position of the elevator cage at various times for travelling between different flows.
Figure 13:
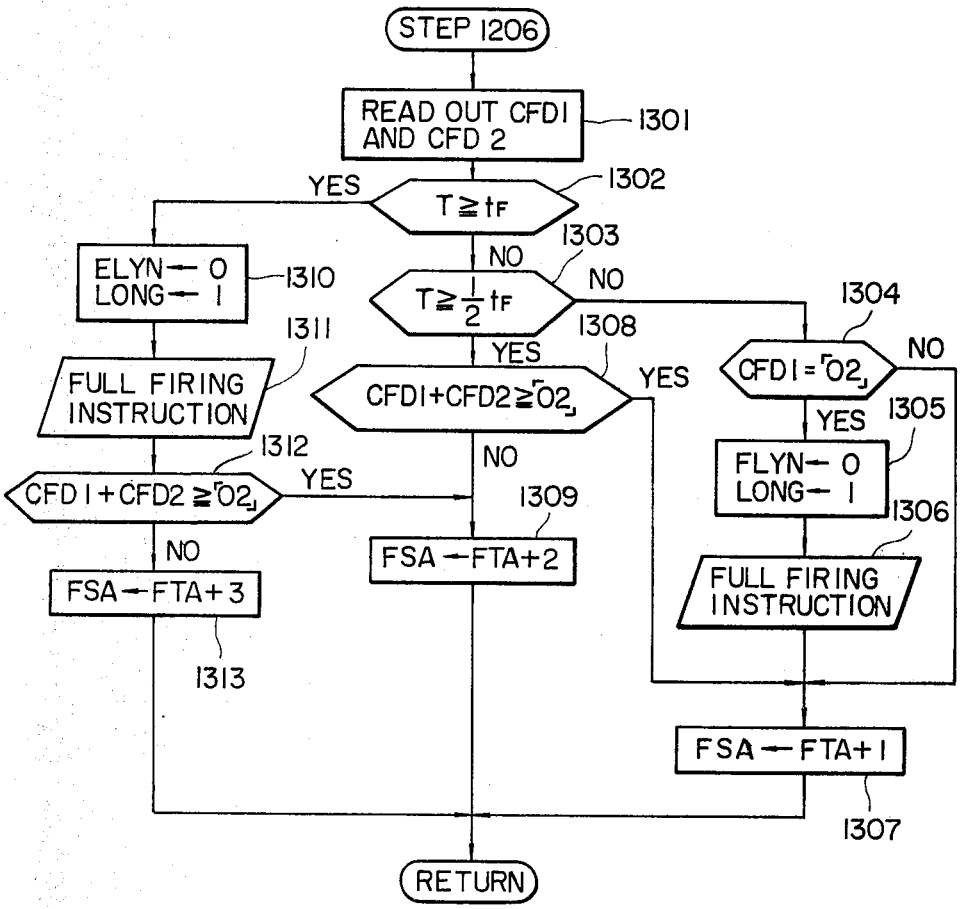

Step 1206 for early notching calculation is illustrated in FIG. 13 in detail. First, in Step 1301, a floor distance code CFD1 for a floor ahead of the first floor and a floor distance code CFD2 for a floor ahead of the second floor are read out of a table stored in the ROM 204. For instance in the case where the cage is moved upwardly from the first floor, the codes 23*a* and 23*b* are extracted and CFD1="01" and CFD2="01" are determined in Step 1301. With $0 \leqq T < \frac{1}{2}fF$, as is clear from Step 1302 and 1303, Step 1304 is effected. Since CFD1="01", the processes in Steps 1305 and 1306 are omitted as is apparent from the decision conditions in Step 1304. Thus, Step 1307 is carried out. In Step 1307, the forward floor FSA is set with a start floor FTA+1, and therefore in this case FSA=1+1=2 (second floor). With $\frac{1}{2}fF \leqq T < fF$, the decision in Step 1308 is carried out because of the decision processes in Step 1302 and 1303. In this case CFD1+CFD2="01"+"01"="02". Therefore, the process in Step 1307 is carried out and the forward floor is still the second floor. So long as $fF \leqq T$, the flag ELYN is reset to 0, since the early notching calculation is not carried out and the forward floor is calculated in Steps 1204 and 1205. A flag LONG is set to 1, and the rated speed operation is determined. Then, in Step 1311 the full-firing instruction is outputted. Furthermore, in Step 1312 it is determined whether or not CFD1+CFD2 is "02" or more. In this case, it is "02". Therefore, the forward floor is changed from the second floor to the third floor. In consequence, as shown in FIG. 7B, FSA is subjected to early-notching.

Figure 14:
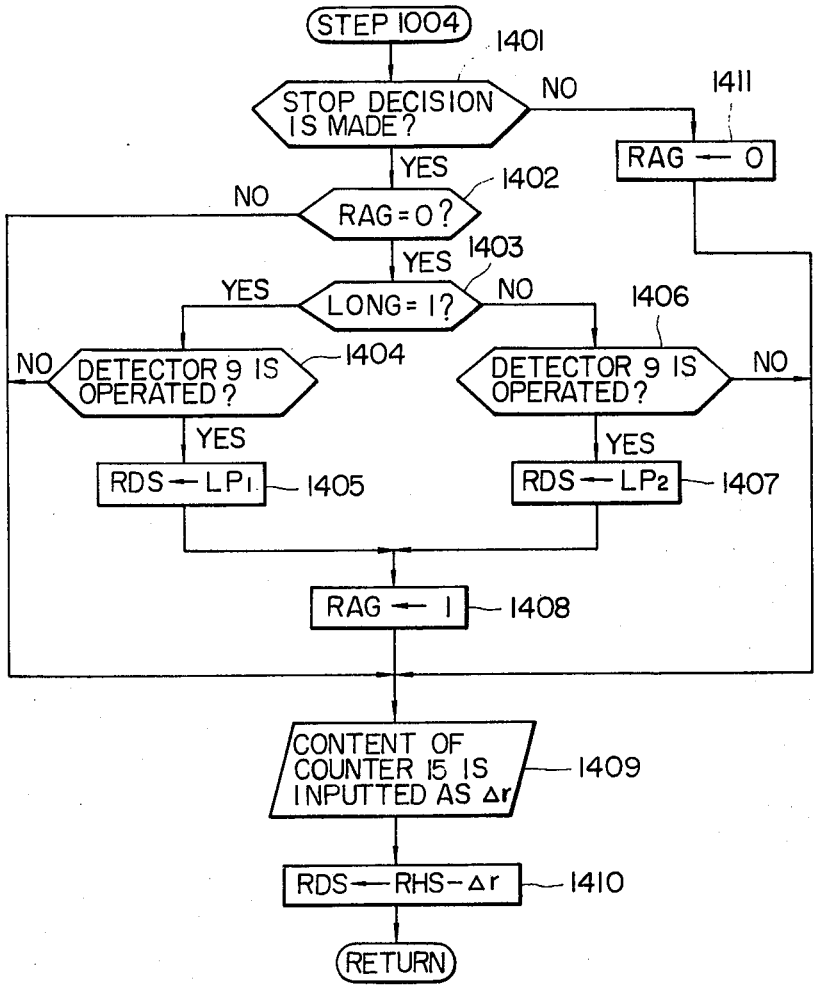

Step 1004 for performing the remaining distance calculation will be described with reference to FIG. 14. When it is decided that a stop decision has been made in Step 1401, the state of flag RAG is sensed (in Step 1402). If it is 0, the status of flag RAG is determined in the next Step 1403. It is assumed that the cage is moved upwardly from the first floor in response to the call for the fourth floor. As was described before, the rated speed operation has been determined and LONG=1 has been set in Step 1206. Therefore, the process in Step 1404 is effected. When the cam 4A for the fourth floor is detected by the detector 9, in Step 1405 a value LP1 corresponding to the distance between the cam 4A and the level of the fourth floor is initially set as the remaining distance RDS. The flag RAG is set to 1 (in Step 1408) and the processes in Steps 1403 through 1408 are disregarded. Thereafter, the content of the counter 15 is inputted as $\Delta r$ (in Step 1409) and $\Delta r$ is subtracted from the remaining distance RDS (in Step 1410) so that the remaining distance to the level of the fourth floor is calculated at all times.

Figure 15:
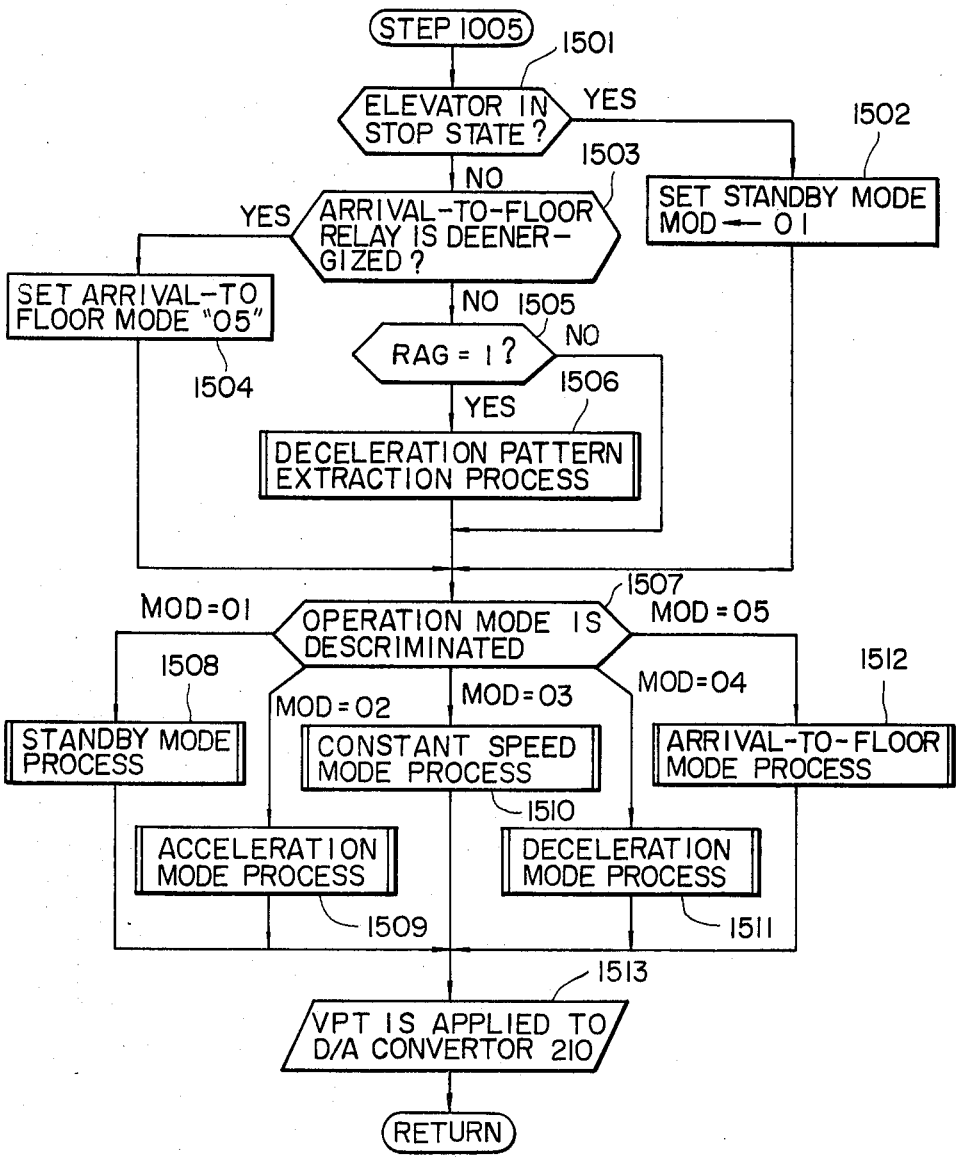

The process in Step 1005 for pattern calculation is as shown in FIG. 15. It is determined whether or not the elevator is in the stopped state (Step 1501). If the elevator is in the stopped state, then in Step 1502 an operational mode flag MOD is set to a standby mode "01". If it is not in the stopped state, then in Step 1503 the state of an arrival-to-floor relay is sensed which is deenergized when a position detector (not shown) is operated by a cam (not shown) which is disposed in the lift path and in the vicinity of a floor at which the cage is requested to stop. If the relay has been deenergized, then the flag MOD is set to an arrival-to-floor mode "05". In Step 1505 the state of the flag RAG is discriminated. If it has been set to 1, i.e. if the remaining distance calculation in Step 1004 has been started, then a deceleration pattern extraction process is carried out in Step 1506. Step 1507 is a routine for determining the state of an operational mode flag MOD. If MOD=1, Step 1508 for standby mode process is effected. If MOD=02, Step 1509 for acceleration mode process is effected. If MOD=3, Step 1510 for constant speed mode process is effected. If MOD=4, Step 1511 for deceleration mode process is effected. If MOD=5, Step 1512 for arrival-to-floor mode process is effected. Finally, in Step 1513 data VPT is applied to the D/A converter 210. Thus, a series of processes have been accomplished.

FIG. 16 is a flow chart showing details of Step 1506 for performing deceleration pattern extraction process. First, in Step 1601 the sum of the remaining distance RDS and the top address VDI of the deceleration pattern table stored in the ROM 204 is set in an index register. In the next Step 1602, deceleration pattern data is extracted from an address indicated by the index register (HL) and is stored, as a deceleration pattern VDC, in a predetermined address of the RAM 205.

FIGS. 17 through 21 are flow charts showing the contents of the operation mode processes mentioned above. FIG. 17 shows the contents of the standby mode process. A D/A output pattern VPT set in a predetermined address of the RAM 205 is set to a rated speed VLR (Step 1701). The flag mode MOD is set to the acceleration mode "02" (Step 1702) and the flag LONG is reset to 0.

FIG. 18 shows the contents of the acceleration mode process. In Step 1801, the sum of the variable T calculated in Step 1002 and the top address VAI of the acceleration pattern table is set in the index register (HL). In Step 1802, the acceleration pattern data is extracted from an address indicated by the index register (HL) and is stored in the pattern VPT. In Step 1803, the state of the flag LONG is decided. In this case, because of the rated speed operation, the flag LONG has been set to 1, and therefore Step 1804 is effected. In Step 1804, the pattern VPT is compared with the rated speed VLR. If $VPT \geqq VLR$, then in Step 1805 VTR is set to VLR. In Step 1806, the flag MOD is set to a constant speed mode "03". On the other hand, in the case of partial speed operation (LONG=0), VPT is compared with a value VAM lower than the rated speed. In the next Step 1808, control is effected so that VPT does not exceed VAM. In Step 1809, the deceleration pattern VDC is compared with the pattern VPT. If $VPT \geqq VDC$, in Step 1810 the flag MOD is set to a deceleration mode "04". If $VPT < VDC$, the process in Step 1810 is omitted. Thus, the acceleration mode process (Step 1509) has been accomplished.

FIG. 19 shows the contents of the constant speed mode process. In Step 1901, the pattern VPT is held to the rated speed VLR. In Step 1902, VPT is compared with VDC. If $VPT > VDC$, then in Step 1903 the flag MOD is set to a deceleration mode "04" and, if not, Step 1903 is omitted. Thus, the process in Step 1510 has been achieved.

Step 1511 for deceleration mode process is shown in FIG. 20 in detail. In Steps 2001 and 2002, in the case of the rated speed operation, LONG=1, and therefore the full-firing instruction output is turned off. In Step 2003, the deceleration pattern VDC is set as the pattern VPT.

After the arrival-to-floor relay has been de-energized, the instruction pattern is made negative in order to improve the floor-arrival performance of the cage of the elevator. Accordingly, in the arrival-to-floor mode process in FIG. 21, only Step 2101 for setting the pattern VPT to an arrival-to-floor pattern -VST is carried out.

As is apparent from the above description, in accordance with the invention, the floor distance codes which are obtained by coding the distance between the floors are stored, the floor distance codes are read out according to the distance between floors where the cage is started and stopped, respectively, and, with the aid of the values corresponding to the floor distance codes, the cage is run selectively at the maximum rated speed or at a speed lower than the maximum rated speed.

Furthermore according to the invention, when the cage reaches a position a predetermined distance before a floor where the cage should be stopped, the remaining distance between the position and the floor is calculated to provide the corresponding deceleration instruction signal, and the deceleration instruction signal is compared with the acceleration instruction signal. If, in this case, the acceleration instruction signal is smaller in value than the deceleration instruction signal, the acceleration instruction signal is outputted as the speed instruction signal. If the acceleration instruction signal is equal to or larger than the deceleration instruction signal, then the deceleration instruction signal is outputted as the speed instruction signal.

Thus, through simple calculations, a high transportation efficiency is provided. Furthermore, in the case of partial speed operation also, the optimum speed instruction signal is provided with the use of the invention. Therefore, the operational efficiency of an elevator system employing the invention is remarkably improved and heat generation and power consumption of the motor are minimized.

In addition, according to the invention, the highest value of the acceleration instruction signal is maintained lower than the value corresponding to the maximum rated speed. Therefore, even in the case where the cage is run for a long distance between floors, the cage can be decelerated to a desired floor without exerting a discomfortably high deceleration force on the passengers.

What is claimed is:

1. An elevator control device comprising:

memory means for storing floor distance codes representative of distances between floors; and means for determining which floors are to be traversed, selectively reading out of said memory means said floor distance codes corresponding to said floors to be traversed, synthesizing said floor distance codes, whereby a distance to be traversed is determined, and selecting at least one of an operational mode in which said cage is run at a maximum rated speed and an operational mode in which said cage is run at a speed lower than said maximum rated speed in accordance with said distance to be traversed so that said cage is accelerated by an acceleration instruction signal, and when said cage reaches a position a predetermined distance before said floor where said cage is to be stopped, the remaining distance between said position and said floor where said cage is to be stopped is calculated to provide a deceleration instruction signal corresponding to said remaining distance, wherein said acceleration instruction signal is compared with said deceleration instruction signal, and when said acceleration instruction signal is smaller than said deceleration instruction signal, said acceleration instruction signal is provided as a speed instruction signal while when said acceleration instruction signal is equal to or larger than said deceleration instruction signal, said deceleration instruction signal is provided as a speed instruction signal.

2. An elevator control device comprising:

memory means for storing floor distance codes representing distances between floors;

means for determining which floors are to be traversed, selectively reading out of said memory means said floor distance codes corresponding to said floors to be traversed, synthesizing said floor distance codes, whereby a distance to be traversed is determined, and for selecting at least one of an operational mode in which said cage is run at a maximum rated speed and an operational mode in which said cage is run at a speed lower than said maximum rated speed in accordance with said distance to be traversed so that said cage is accelerated by an acceleration instruction signal, and when said cage reaches a position a predetermined distance before said floor where said cage is to be stopped, the remaining distance between said position and said floor where said cage is to be stopped is calculated to provide a deceleration signal corresponding to said distance;

first means for holding the maximum value of said acceleration instruction signal at a value lower than a value corresponding to said rated speed, whereby the velocity of said elevator will be at such a value as said elevator will be linearly decelerated through said predetermined distance by said deceleration signal; and second means for comparing said acceleration instruction signal with said deceleration instruction signal, and when said deceleration instruction signal is smaller than said deceleration instruction signal, providing said acceleration instruction signal as a speed instruction signal and when said acceleration instruction signal is equal to or larger than said deceleration instruction signal, providing said deceleration instruction signal as a speed instruction signal.

3. The elevator control device of claims 1 or 2 further comprising: a plurality of up maximum rated speed deceleration preparation point detecting cams disposed predetermined distances between floors; a plurality of up partial speed deceleration preparation point detecting cams disposed at positions closer to adjacent floors than said up maximum rated speed deceleration preparation point detecting cams; an up maximum rated speed operation deceleration point detector mechanically coupled to said cage and electrically coupled to inputs of said reading means; an up partial speed operation deceleration point detector mechanically coupled to said cage and electrically coupled to inputs of said reading means; an induction motor for raising and lowering said cage; a pulse generator electrically coupled to be driven by said motor for producing pulses in proportion to the speed of said motor; a counter coupled to an output of said pulse generator for counting the number of pulses produced by said pulse generator, an output of said counter being coupled to said reading means; a speed instruction generator, comprising a microprocessor, which in turn comprises said reading means, a random access memory, a central processing unit, an interruption period control timer, and input and output parts, and further comprising means for processing a speed instruction signal produced by said microprocessor; converter means for counting the number of pulses produced by said pulse generator and converting the count results to an analog speed signal proportional to the speed of said motor; subtractor means for producing a signal representing the difference between said speed signal and said speed instruction produced by said speed instruction generator; amplifier means for amplifying an output of said subtractor means; a call register for reading and storing elevator calls, originating from said elevator and from said floors; a floor controller, in which the output of said call register and an output of the speed instruction generator are compared, which in turn outputs a stop determining signal to said speed instruction generator; full fire signal generator means coupled to be operated in accordance with an output of said speed instruction generator; adder means for adding output signals produced by said amplifier means and said full fire signal generator means; thyristor means coupled to be operated in accordance with an output of said adder means for controlling said motor.

* * * * *